US009511971B2

(12) United States Patent
Noso et al.

(10) Patent No.: US 9,511,971 B2
(45) Date of Patent: Dec. 6, 2016

(54) SHEET POST-PROCESSING DEVICE AND SHEET POST-PROCESSING METHOD

(71) Applicant: KYOCERA Document Solutions Inc., Osaka (JP)

(72) Inventors: Terumitsu Noso, Osaka (JP); Masahiko Miyazaki, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/957,147

(22) Filed: Dec. 2, 2015

(65) Prior Publication Data

US 2016/0176670 A1 Jun. 23, 2016

(30) Foreign Application Priority Data

Dec. 18, 2014 (JP) ..... 2014-255926

(51) Int. Cl.

| | |
|---|---|
| ***B65H 29/12*** | (2006.01) |
| ***B65H 31/02*** | (2006.01) |
| ***B65H 31/30*** | (2006.01) |
| ***B65H 31/36*** | (2006.01) |
| ***B65H 31/34*** | (2006.01) |
| ***B65H 39/00*** | (2006.01) |

(52) U.S. Cl.

CPC ..... *B65H 29/125* (2013.01); *B65H 31/02* (2013.01); *B65H 31/3027* (2013.01); *B65H 31/34* (2013.01); *B65H 31/36* (2013.01); *B65H 39/00* (2013.01); *B65H 2301/4212* (2013.01); *B65H 2301/4213* (2013.01); *B65H 2403/90* (2013.01); *B65H 2403/942* (2013.01); *B65H 2404/1441* (2013.01); *B65H 2404/1521* (2013.01); *B65H 2404/693* (2013.01); *B65H 2511/20* (2013.01); *B65H 2511/30* (2013.01); *B65H 2801/27* (2013.01)

(58) Field of Classification Search

CPC ..... B65H 29/12; B65H 29/125; B65H 31/34; B65H 37/04; B65H 2408/114; B65H 2408/1142; B65H 2408/1143; B65H 2408/121; B65H 31/3027; B65H 2801/27

USPC ..... 271/58.08, 58.12

See application file for complete search history.

(56) References Cited

U.S. PATENT DOCUMENTS

2010/0019435 A1* 1/2010 Fukami ..... B65H 37/04 270/58.11

2014/0110896 A1 4/2014 Ishikawa et al. ..... 217/3.18

FOREIGN PATENT DOCUMENTS

JP 2013-224221 A 10/2013

* cited by examiner

*Primary Examiner* — David H Bollinger

(74) *Attorney, Agent, or Firm* — Stein IP, LLC

(57) ABSTRACT

In a sheet post-processing device, the front end portion of a sheet (P) transported onto a post-processing tray makes contact with a paper discharge tray, and thus it is possible to prevent the sheet (P) from being curled excessively. When the first sheet (P) in a stack of sheets to be subjected to post-processing in a post-processing portion is transported onto the paper discharge tray, the standby position of a drive roller forming a paper discharge roller pair is set between the maximum separate position and a nip position on a driven roller.

5 Claims, 10 Drawing Sheets

SHEET POST-PROCESSING DEVICE AND SHEET POST-PROCESSING METHOD

The present application is based upon and claims the benefit of priority from the corresponding Japanese Patent Application No. 2014-255926 filed on Dec. 18, 2014, the entire contents of which are incorporated herein by reference.

BACKGROUND

The present disclosure relates to a sheet post-processing device that performs post-processing on a sheet on which image formation has been performed with an image forming apparatus such as a copying machine or a printer and a sheet post-processing method.

As this type of sheet post-processing device, a device is known that collects sheets in a stack in which an image is formed and that performs post-processing on the stack of sheets. For example, in a conventional sheet post-processing device, as an example of the post-processing, stapling processing is performed in which one ends of the stack of sheets are aligned and bound. The sheet post-processing device includes a case member that has a paper feed port and a paper discharge port. Within the case member, a main transport path and a post-processing transport path are provided. The main transport path receives a sheet supplied from the paper feed port and guides it to the paper discharge port. One end portion of the post-processing transport path is connected to a downstream-side end portion of the main transport path. At the other end portion of the post-processing transport path, a staple unit is provided. In a connection portion of the main transport path to the post-processing transport path, a drive roller that is driven by a motor is provided. On the side of the drive roller, a rotation alignment member is provided. On the lower side of the drive roller, a sheet support unit is provided. In a position of the sheet support unit opposite the drive roller, a driven roller is rotatably provided. The driven roller can be moved to a nip position where a nip portion is formed between the drive roller and the driven roller and to a maximum separate position that is separate a predetermined distance from the driven roller.

In the alignment of sheets, the drive roller is first driven by a drive means to the maximum separate position. In this state, the sheet is transported from the main transport path onto the sheet support unit. Here, the drive roller is separate from the driven roller. The sheet transported onto the support unit is supplied by the rotation alignment member to the post-processing transport path and is guided to the staple unit. Then, the back edge of the sheets makes contact with a reference plate portion of the staple unit, and thus the sheets are aligned. On the sheets collected in a stack after the completion of the alignment of the sheets, stapling processing is performed by the staple unit.

After the performance of the stapling processing, the drive roller is driven by the drive means from the maximum separate position to the nip position. In this state, the drive roller is rotated in a positive rotation direction, and thus the stack of sheets is discharged to a paper discharge tray. The paper discharge tray is connected to a lower side with respect to the paper discharge port on the outer wall surface of the post-processing device. The paper discharge tray is inclined toward the upper side from an upstream side to a downstream side in a paper discharge direction.

In the conventional sheet post-processing device described above, the front end portion of the sheet transported onto the support unit (on a post-processing tray) protrudes from the paper discharge port to the side of the paper discharge tray. Here, disadvantageously, for example, when the front end portion of the sheet is curled downward, the front end portion of the sheet hits the paper discharge tray and moves to a base end side (the upstream side of the paper discharge tray in the paper discharge direction), and thus the curling of the sheet further proceeds or the front end portion of the sheet is kept pressed to the paper discharge tray and is prevented from being moved in the paper discharge direction, with the result that the front end portion of the sheet is swelled upward. Consequently, disadvantageously, the sheet is excessively curled, and thus a paper jam occurs when the sheet is transported by the rotation alignment member to the post-processing transport path, and a failure occurs in the alignment of the sheets.

SUMMARY

According to one aspect of the present disclosure, there is provided a sheet post-processing device including a housing which includes a paper feed port and a paper discharge port, a main transport path which transports a sheet from the paper feed port to the paper discharge port, a paper discharge tray which is provided outside the housing and which receives the sheet discharged from the paper discharge port, a paper discharge roller pair which is provided at a downstream-side end portion of the main transport path, a supply roller pair which is arranged on an upstream side with respect to the paper discharge roller pair of the main transport path, a post-processing transport path whose one end portion is connected to the downstream-side end portion of the main transport path and whose other end portion is connected to a post-processing portion that performs post-processing on a stack of sheets, a post-processing tray which is arranged along the post-processing transport path and on which the sheets supplied by the supply roller pair are sequentially stacked, and a reference plate portion which is provided in the post-processing portion and which makes contact with the back edge of the sheets supplied onto the post-processing tray to align the sheets.

The paper discharge roller pair includes a driven roller and a drive roller which is arranged opposite the driven roller and which can be moved between a nip position where a nip portion is formed between the drive roller and the driven roller and a maximum separate position a predetermined distance separate from the driven roller, the post-processing device includes a drive controller which controls an operation of rotation of the drive roller and an operation of separating from and making contact with the driven roller by the drive roller, the drive controller separates the drive roller from the driven roller to place the drive roller on standby in a predetermined standby position when the sheet is supplied and transported by the supply roller pair onto the post-processing tray, moves the drive roller to the nip position after the back edge of the sheet is passed through the supply roller pair and rotates the drive roller in a reverse rotation direction so as to bring the back end of the sheets into contact with the reference plate portion and to align the sheets and the standby position of the drive roller when a first sheet in the stack of sheets to be subjected to the post-processing by the post-processing portion is transported onto the post-processing tray is a position between the maximum separate position and the nip position.

According to another aspect of the present disclosure, there is provided a sheet post-processing method by the sheet post-processing device configured as described above, where when the sheet is transported to the post-processing tray, the driven roller and the drive roller forming the paper discharge roller pair are separated in the predetermined standby position between the nip position and the maximum separate position, and after the back edge of the sheet transported is passed through the supply roller pair, the drive roller is moved to the nip position to be rotated in the reverse rotation direction so as to bring the back end of the sheets into contact with the reference plate portion and to align the sheets.

DETAILED DESCRIPTION

Embodiments of the present disclosure will be described in detail below with reference to drawings. The present disclosure is not limited to the embodiments which will be described below

Embodiments

Figure 1:
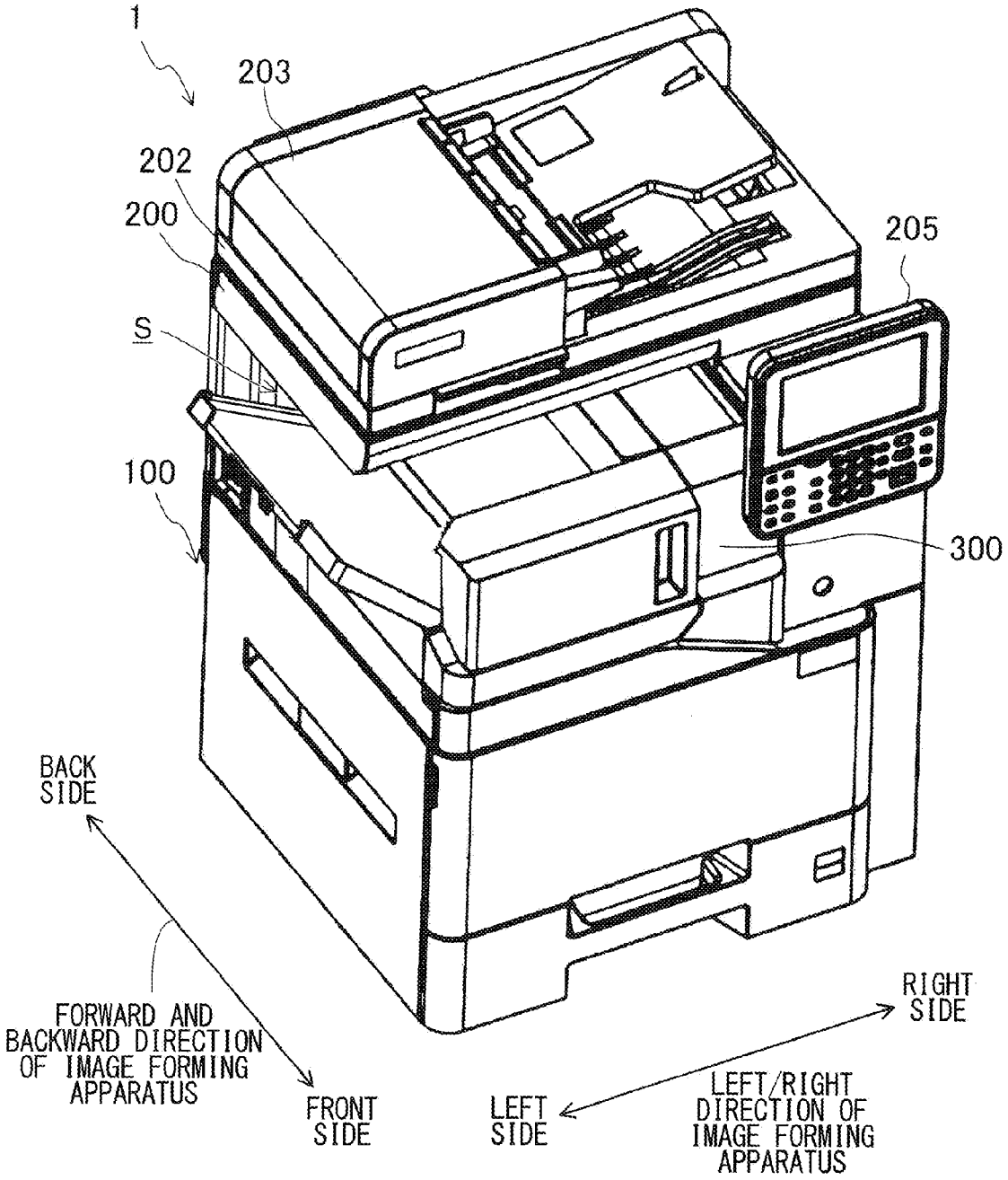
FIG. 1 is a perspective view illustrating an image forming apparatus in an embodiment.
Figure 2:
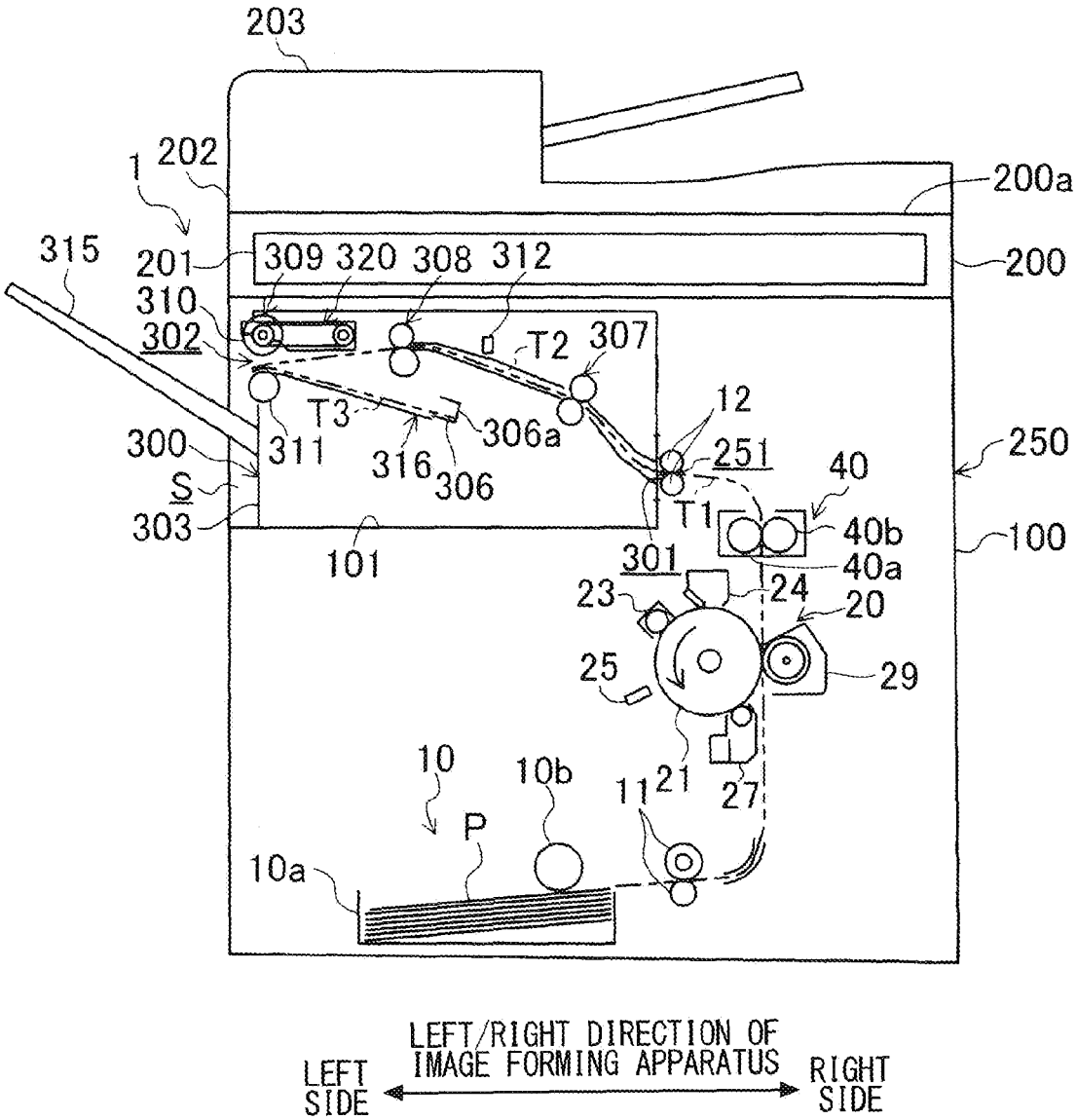
FIG. 2 is a schematic cross-sectional view illustrating an internal structure of the image forming apparatus.

FIGS. 1 and 2 illustrate a digital coping machine which is an example of an image forming apparatus 1 in the present embodiment. The image forming apparatus 1 is a so-called internal paper discharge-type copying machine, and includes a main body housing portion 100, a scanner housing portion 200 and a support housing portion 250 (see FIG. 2). Within the scanner housing portion 200, an image reading portion 201 for reading an original document image is placed, and within the main body housing portion 100, an image formation portion 20 and a fixing portion 40 for printing, on a sheet P, the original document image read by the image reading portion 201 are placed. The main body housing portion 100 is arranged on the lower side with respect to the scanner housing portion 200, and the scanner housing portion 200 is supported to the main body housing portion 100 through the support housing portion 250. The support housing portion 250 is extended upward from an upper portion of the main body housing portion 100 to support the scanner housing portion 200 from below. Between the main body housing portion 100 and the scanner housing portion 200, a sheet discharge space S is formed. On the front surface of the support housing portion 250, an operation panel 205 is provided in which a user performs various types of operation instructions on the image forming apparatus 1. In a vertical wall portion facing the sheet discharge space S in the support housing portion 250, a paper discharge port 251 for discharging a sheet P into the sheet discharge space S is formed. Within the sheet discharge space S, a post-processing device 300 which will be described later is removably placed.

The upper surface of the scanner housing portion 200 forms a translucent original document placement surface 200*a* on which an original document is placed. The original document placement surface 200*a* is covered by an original document cover 202 such that the original document cover 202 can be opened and closed. The original document cover 202 is formed in the shape of a rectangle in plan view, and covers the original document placement surface 200*a* such that the original document cover 202 can be opened and closed. The image reading portion 201 optically reads the original document placed on the contact glass of the original document placement surface 200*a* to generate the image data thereof. The image data generated by the image reading portion 201 is stored in an unillustrated data storage portion.

The main body housing portion 100 is formed substantially in the shape of a rectangular parallelepiped, and the image formation portion 20 is arranged on the right side in the upper portion within the main body housing portion 100. Above the image formation portion 20, the fixing portion 40 is provided, and in the left side and the lower side of the image formation portion 20, a paper feed portion 10 is provided. The paper feed portion 10 includes a paper feed cassette 10*a* in which the sheet P in the shape of a sheet is placed and a pickup roller 10*b* for picking up the sheet P within the paper feed cassette 10*a* and feeding out it out of the cassette. The sheet P fed out of the paper feed cassette 10*a* is supplied through a transport roller pair 11 to the image formation portion 20.

The image formation portion 20 includes a photosensitive drum 21, a charging unit 23, an exposure device 25, a development device 27 and a transfer unit 29. In the image formation portion 20, the charging unit 23 first charges the circumferential surface of the photosensitive drum 21, then the exposure device 25 applies, to the surface of the photosensitive drum 21, laser light based on original document image data (the image data on the original document image generated by the image reading portion 201) to form an electrostatic latent image, the development device 27 develops the formed electrostatic latent image to form a toner image and thereafter the transfer unit 29 transfers the toner image to the sheet P supplied from the paper feed portion 10 and supplies the sheet P after the transfer to the fixing portion 40. A reference numeral 24 in the figure represents a cleaning portion that cleans the remaining toner left on the surface of the photosensitive drum 21.

The fixing portion 40 includes a fixing roller 40*a* and a pressure roller 40*b*. The fixing roller 40*a* is heated by a heater therewithin. In the fixing portion 40, the sheet P supplied by the image formation portion 20 is pressurized and heated between the fixing roller 40*a* and the pressure roller 40*b*, and thus the toner image is fixed to the sheet P. Then, the sheet P in which the toner image is fixed in the fixing portion 40 is passed through a transport path T1 and is guided to the paper discharge port 251. The sheet P guided to the paper discharge port 251 is discharged by a discharge roller pair 12 into the sheet discharge space S and is stacked on the bottom wall portion of the sheet discharge space S. When the post-processing device 300 is fitted to the bottom wall portion 101 of the sheet discharge space S, the sheet discharged from the paper discharge port 251 is supplied into the post-processing device 300.

The post-processing device 300 is a device that performs post-processing on the sheet P after the image formation. In the present embodiment, the post-processing is staple processing in which a needle (staple) in the shape of the letter U is made to penetrate the end portion of the sheets P that make contact with a reference plate portion 306*a* and that are collected in a stack and in which the staple is bent flat. The staple processing is performed by a stapler 306.

The post-processing device 300 includes a case member 303 formed substantially in the shape of a rectangular parallelepiped. With the post-processing device 300 fitted to the bottom wall portion 101 of the sheet discharge space S, the right-side wall portion of the case member 303 makes contact with the vertical wall portion in which the paper discharge port 251 in the support housing portion 250 is formed. In the right-side wall portion of the case member 303, a paper feed port 301 is formed, and in the left-side wall portion, a paper discharge port 302 is formed. A paper discharge tray 315 is connected to the lower side of the left-side surface of the case member 303 with respect to the paper discharge port 302. The paper discharge tray 315 is inclined upward from the right side to the left side (from the upstream side to the downstream side in the paper discharge direction). Within the case member 303, a main transport path T2 and a post-processing transport path T3 are provided. The main transport path T2 is extended from the paper feed port 301 to the paper discharge port 302.

In the main transport path T2, a first transport roller pair 307, a second transport roller pair (which corresponds to a supply roller pair) 308 and a paper discharge roller pair 309 are arranged in this order from the upstream side to the downstream side. The sheet P is sandwiched and transported by the roller pairs 307 to 309 from the paper feed port 301 to the paper discharge port 302. The first transport roller pair 307 and the second transport roller pair 308 are arranged in an intermediate portion of the main transport path T2 in the transport direction. Between the first transport roller pair 307 and the second transport roller pair 308, a sheet back end detection sensor 312 is provided that detects the back end (the upstream-side end in the transport direction) of the sheet P. The sheet back end detection sensor 312 is formed with, for example, a transmissive or reflective optical sensor.

The paper discharge roller pair 309 is provided in the paper discharge port 302 located at the downstream-side end portion of the main transport path T2 in the transport direction. The paper discharge roller pair 309 includes a drive roller 310 and a driven roller 311. The outer circumferential surface of the drive roller 310 is formed with, for example, a rubber member so as not to slide when making contact with the outer circumferential surface of the sheet P. Both the rollers 310 and 311 are extended in a forward and backward direction, and are arranged side by side in an up/down direction. The drive roller 310 is driven to rotate by a first motor 323 which will be described later. Both the end portions of the driven roller 311 are rotatably supported by wall portions on the front side and the back side of the case member 303, and are rotated so as to be driven by the rotation of the drive roller 310. The drive roller 310 is arranged on the upper side with respect to the driven roller 311. Then, the drive roller 310 is driven in the up/down direction by a roller separate/contact mechanism 320 which will be described later such that the drive roller 310 can be separated from and make contact with the driven roller 311.

One end portion of the post-processing transport path T3 is connected to the downstream-side end portion of the main transport path T2, and the other end portion is connected to the stapler 306. The post-processing transport path T3 is inclined downward from the downstream-side end portion of the main transport path T2 to the right side. The stapler 306 includes a reference plate portion 306*a* that makes contact with the back end portion of the sheets P to align the sheets P.

Between the stapler 306 and the driven roller 311 of the paper discharge roller pair 309, a post-processing tray 316 is arranged. The post-processing tray 316 forms a lower-side wall surface of the post-processing transport path T3. The post-processing tray 316 is inclined downward toward the right side along the post-processing transport path T3. In the post-processing tray 316, the sheets P which are transported from the second transport roller pair (which corresponds to the supply roller pair) 308 are sequentially stacked.

The roller separate/contact mechanism 320 can drive the drive roller 310 between the nip position and a maximum separate position. The roller separate/contact mechanism 320 can hold the drive roller 310 in the nip position, in the maximum separate position or in an arbitrary position therebetween. The nip position refers to a position in which the circumferential surface of the drive roller 310 is pressed onto the circumferential surface of the driven roller 311 to form a nip portion between the drive roller 310 and the driven roller 311. The maximum separate position refers to a position in which the drive roller 310 is most separate from the driven roller 311 in its movable range.

Figure 3:
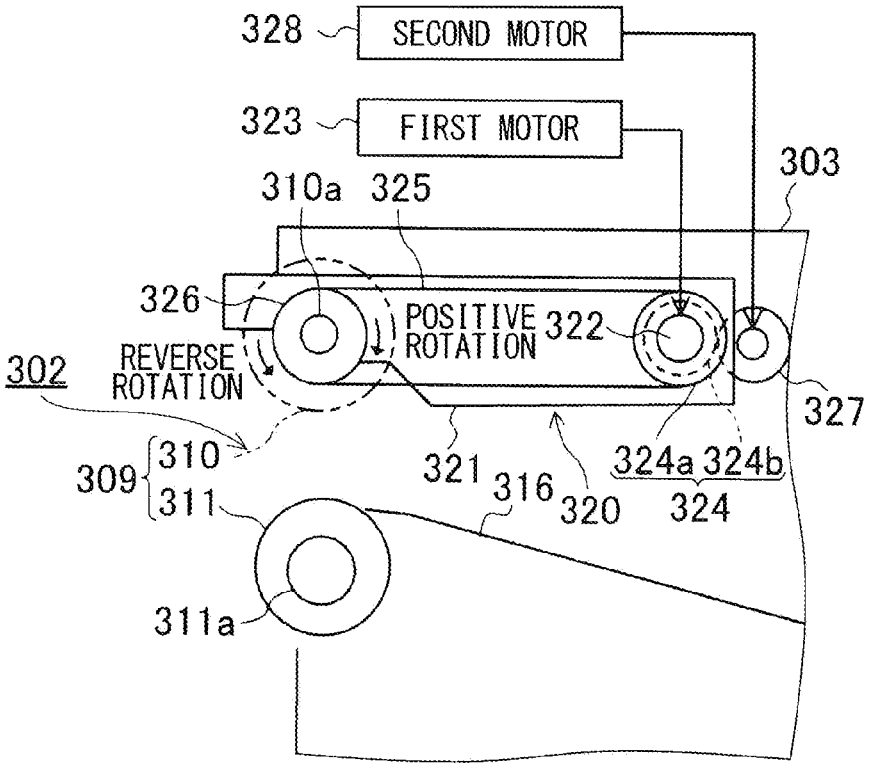
FIG. 3 is a schematic view illustrating a separate/contact mechanism of a drive roller on a driven roller.

As illustrated in FIG. 3, the roller separate/contact mechanism 320 includes a swing lever 321, a support shaft 322 and the first motor 323. The support shaft 322 is coupled to the base end portion of the swing lever 321 such that the support shaft 322 is rotated together therewith. The support shaft 322 is extended in a forward and backward direction and is coupled to the first motor 323. The first motor 323 is fixed to the side wall of the case member 303 and is controlled by a controller 330 (drive controller) which will be described later. A roller shaft portion 310*a* of the drive roller 310 is rotatably supported to the tip end portion of the swing lever 321. When the support shaft 322 is driven to rotate by the first motor 323, the swing lever 321 is swung around the shaft line of the support shaft 322. In this way, the drive roller 310 supported at the tip end portion of the swing lever 321 is moved in the up/down direction with respect to the driven roller 311. The drive roller 310 is moved in the up/down direction as described above, and thus the drive roller 310 can be separated from and make contact with the driven roller 311.

A pulley 326 is fixed to the roller shaft portion 310*a* of the drive roller 310. The pulley 326 is arranged coaxially with the roller shaft portion 310*a*. A gear-equipped pulley 324 is rotatably supported to the support shaft 322. The gear-equipped pulley 324 includes a pulley portion 324*a* and a gear portion 324*b*, and they are arranged coaxially with the support shaft 322. An endless transmission belt 325 is wound around the outer circumferential surface of the gear-equipped pulley 324 (the pulley portion 324*a*) and the outer circumferential surface of the pulley 326. The gear portion 324*b* of the gear-equipped pulley 324 is engaged with a drive gear 327. The drive gear 327 is driven by a second motor 328.

The second motor 328 is fixed to the side wall portion of the case member 303, and is controlled by the controller 330 which will be described later. The drive gear 327 is driven to rotate by the second motor 328, thus the gear-equipped pulley 324 is rotated and the rotation is transmitted by the transmission belt 325 to the pulley 326. Consequently, the roller shaft portion 310*a* coupled to the pulley 326 is rotated, and the drive roller 310 is rotated accordingly.

Figure 4:
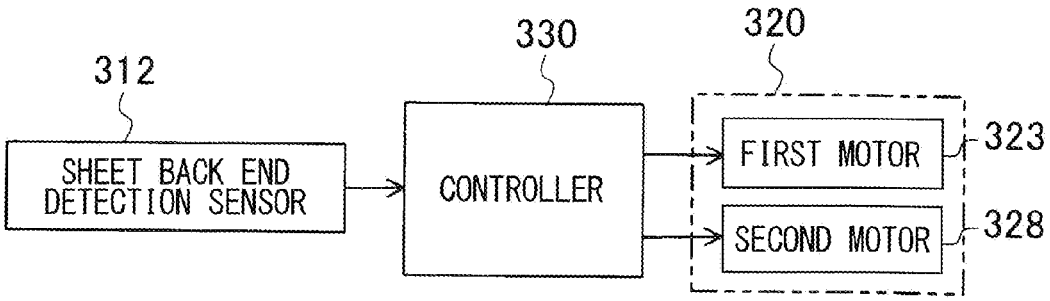
FIG. 4 is a schematic diagram illustrating a block configuration of a control system of a sheet post-processing device.

As illustrated in FIG. 4, the first motor 323 and the second motor 328 are electrically connected to the controller 330. The controller 330 is further electrically connected to the sheet back end detection sensor 312. The controller 330 controls the operations of the first motor 323 and the second motor 328 based on a detection signal from the sheet back end detection sensor 312 to perform sheet transport control below. The controller 330 further drives the second motor 328 to drive and rotate the drive roller 310 in the standby position in a positive rotation direction (direction which is indicated by an arrow in FIG. 5 and in which the sheet P is discharged to the paper discharge tray 315).

Figure 5:
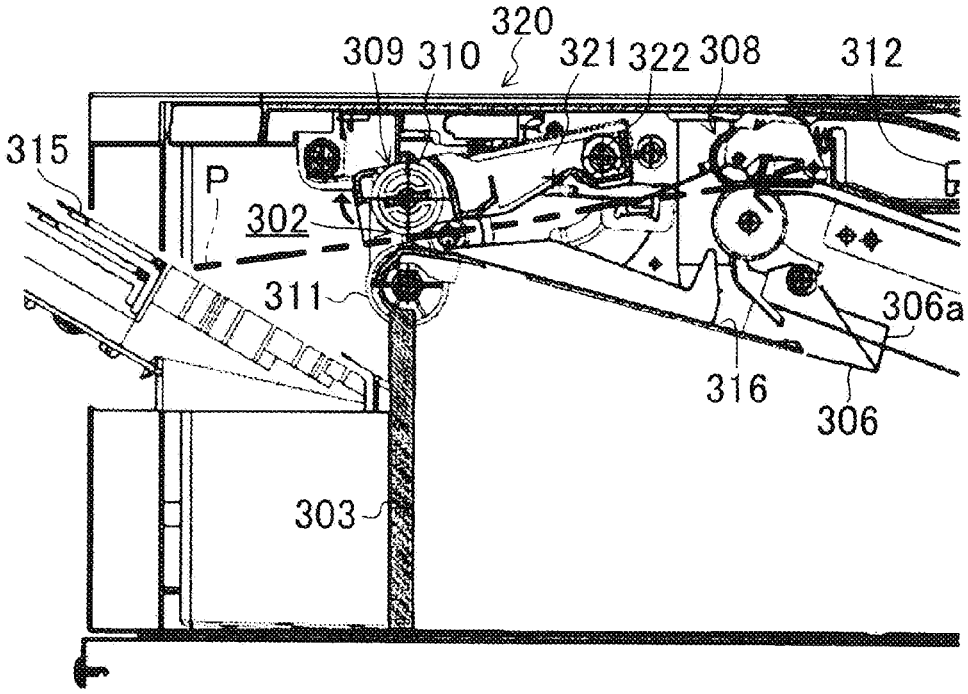
FIG. 5 is an illustrative diagram for illustrating sheet transport control in a controller, and is also a schematic diagram illustrating a state before the back edge of the first sheet transported to a post-processing tray is passed through a supply roller pair.
Figure 6:
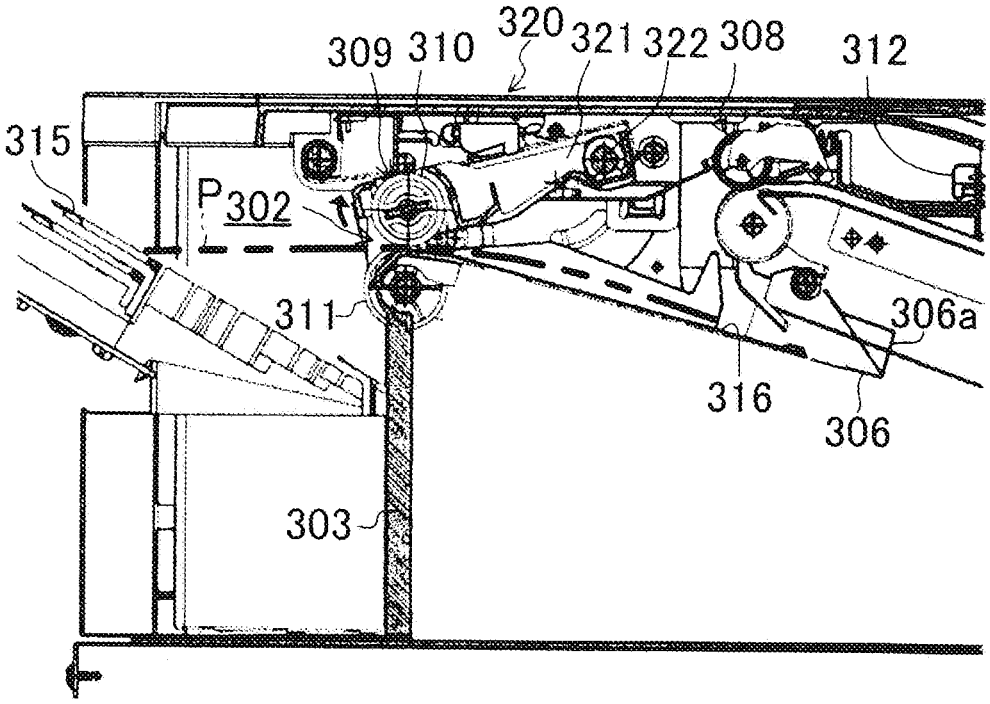
FIG. 6 is an illustrative diagram for illustrating the sheet transport control in the controller, and is also a schematic diagram illustrating a state immediately after the back edge of the first sheet transported to the post-processing tray is passed through the supply roller pair.

When the sheet P is further transported by the second transport roller pair 308 to the downstream side from the state of FIG. 5, as illustrated in FIG. 6, the back end of the sheet P is passed through the second transport roller pair 308. Then, the back end of the sheet P is dropped downward by its weight, and thus most of the back end side of the sheet P is placed on the post-processing tray 316.

When the controller 330 determines that the back end of the sheet P has been passed through the second transport roller pair 308, the controller 330 stops the drive of the second motor 328 to stop the rotation of the drive roller 310, and drives the first motor 323 to move the drive roller 310 from the standby position to the nip position (position indicated in FIG. 6). Here, a determination as to whether or not the back end of the sheet P has been passed through the second transport roller pair 308 is preferably made such as by a time elapsed after the back end of the sheet P is detected by the sheet back end detection sensor 312.

Figure 7:
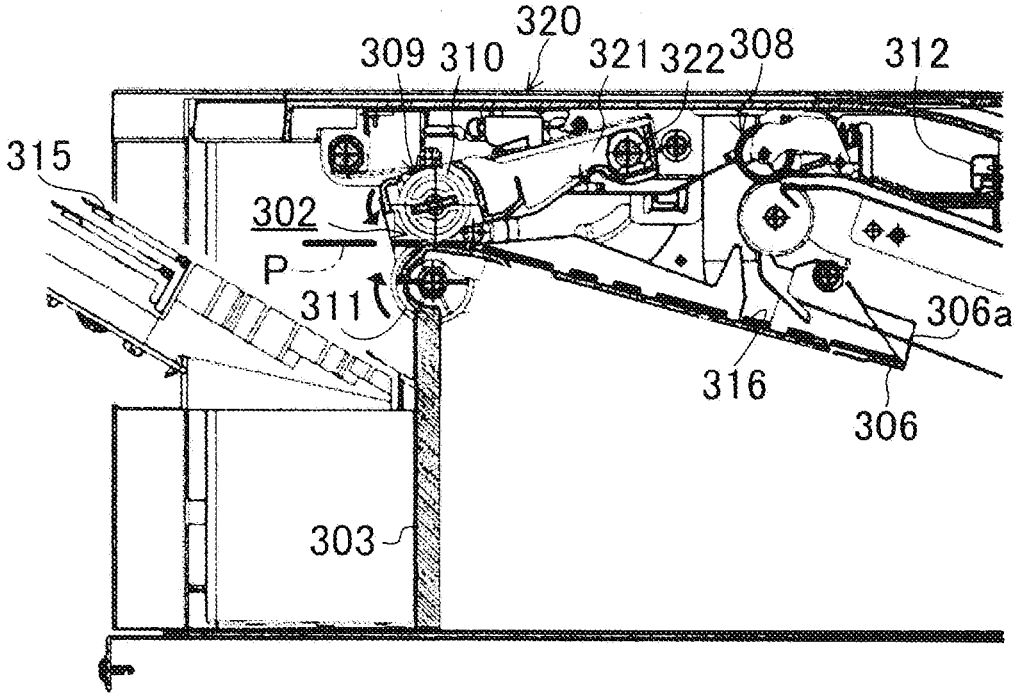
FIG. 7 is an illustrative diagram for illustrating the sheet transport control in the controller, and is also a schematic diagram illustrating a state where the back edge of the first sheet transported to the post-processing tray makes contact with a reference plate portion and is aligned.

After the controller 330 moves the drive roller 310 from the standby position to the nip position, the controller 330 switches the direction of the rotation of the second motor 328 to rotate the drive roller 310 in a reverse rotation direction (direction which is indicated by an arrow in FIG. 7 and in which the sheet P is transported to the side opposite to the side of the paper discharge tray 315), and thereafter stops it. In this way, the sheet P on the post-processing tray 316 is transported in a direction opposite to the paper discharge direction, and the back end of the sheet P makes contact with the reference plate portion 306*a* provided in the stapler 306. Thus, the sheets P are aligned in a predetermined position on the post-processing tray 316.

Figure 8:
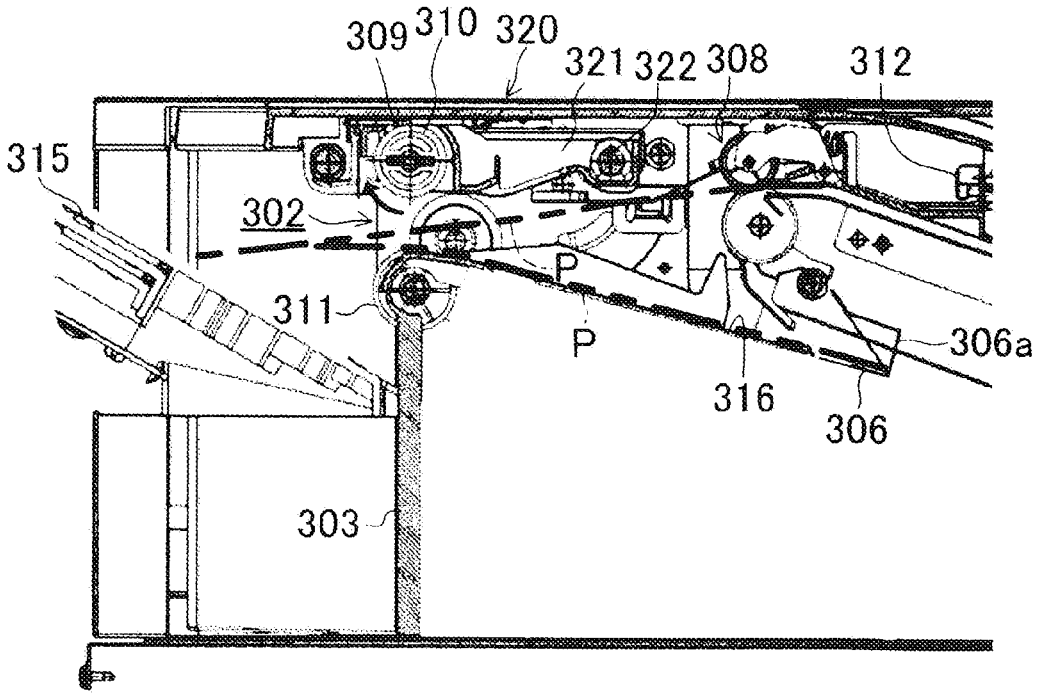
FIG. 8 is an illustrative diagram for illustrating the sheet transport control on the second and subsequent sheets, and is also a diagram corresponding to FIG. 5.

The above description relates to the sheet transport control on the first sheet P by the controller 330. The sheet transport control on the second and subsequent sheets P differs from the control on the first sheet P in the control of FIG. 5. Specifically, on the second and subsequent sheets P, as illustrated in FIG. 8, when the sheet P is transported above the post-processing tray 316, the drive roller 310 is placed on standby in the maximum separate position which is most separate from the driven roller 311. Since the control after the sheet P has been passed through the second transport roller pair 308 is the same as the control on the first sheet P described above, the description thereof will be omitted.

When the number of sheets P stacked and aligned on the post-processing tray 316 reaches a predetermined number of sheets, the controller 330 performs, with the stapler 306, the stapling processing to bind the back end of the stack of sheets. Then, after the completion of the stapling processing by the stapler 306, the controller 330 drives and rotates the drive roller 310 in the positive rotation direction to discharge the sheets P in a stack on which the stapling processing has been performed, from the paper discharge port 302 to the paper discharge tray 315.

As described above, in the first embodiment, since the paper discharge roller pair 309 is utilized to move back the sheets P on the post-processing tray 316 and to bring them into contact with the reference plate portion 306*a*, it is not necessary to additionally provide a member for moving back the sheets P as in a conventional method. Thus, it is possible to reduce the number of components to decrease the product cost.

In the embodiment described above, the standby position of the drive roller 310 when the first sheet P is transported above the post-processing tray 316 is set between the maximum separate position and the nip position. In this way, it is possible to prevent the front end portion of the sheet P from making contact with the paper discharge tray 315 to produce excessive curling on the sheet P.

Figure 9:
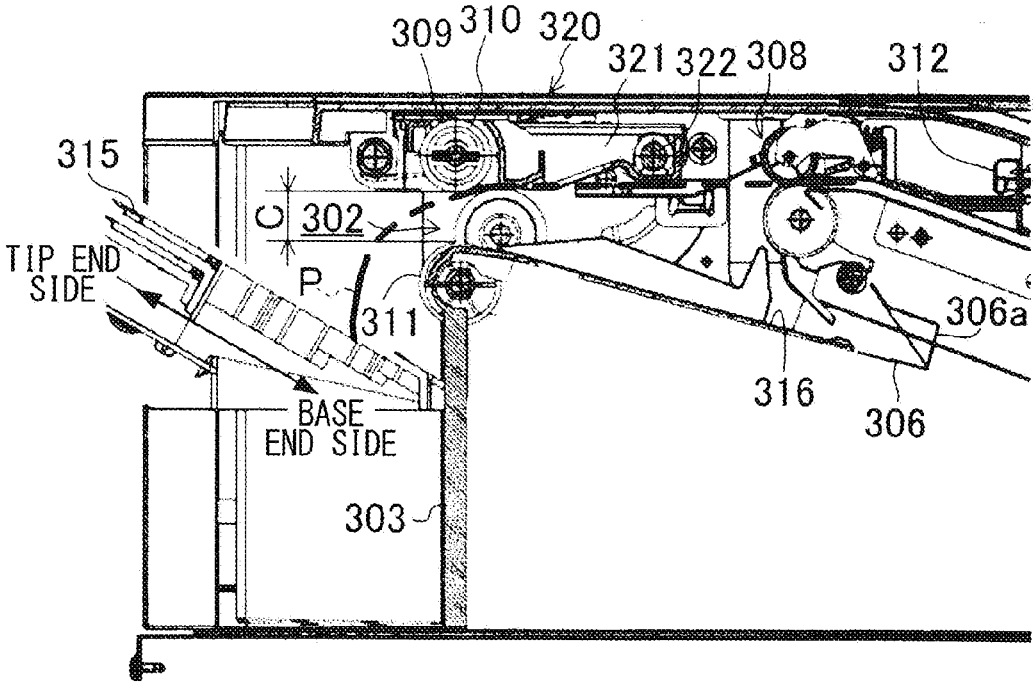
FIG. 9 is a diagram corresponding to FIG. 5 illustrating a comparative example.
Figure 10:
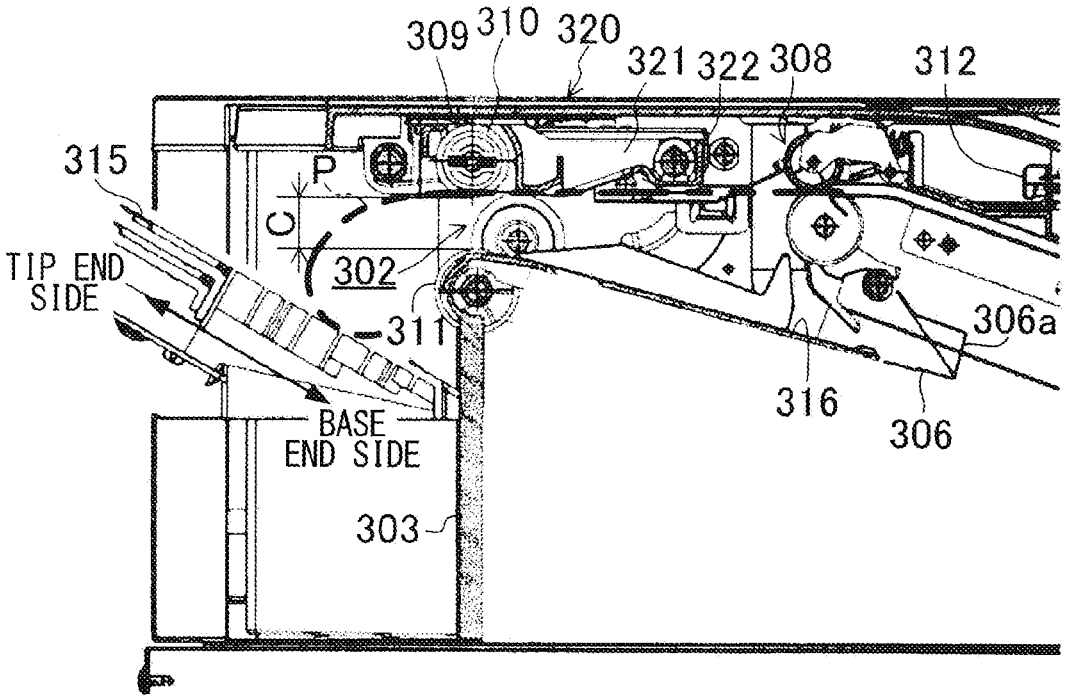
FIG. 10 is a schematic view illustrating how in the comparative example, the front end portion of the sheet makes contact with a paper discharge tray and is moved to the base end side of the paper discharge tray.
Figure 11:
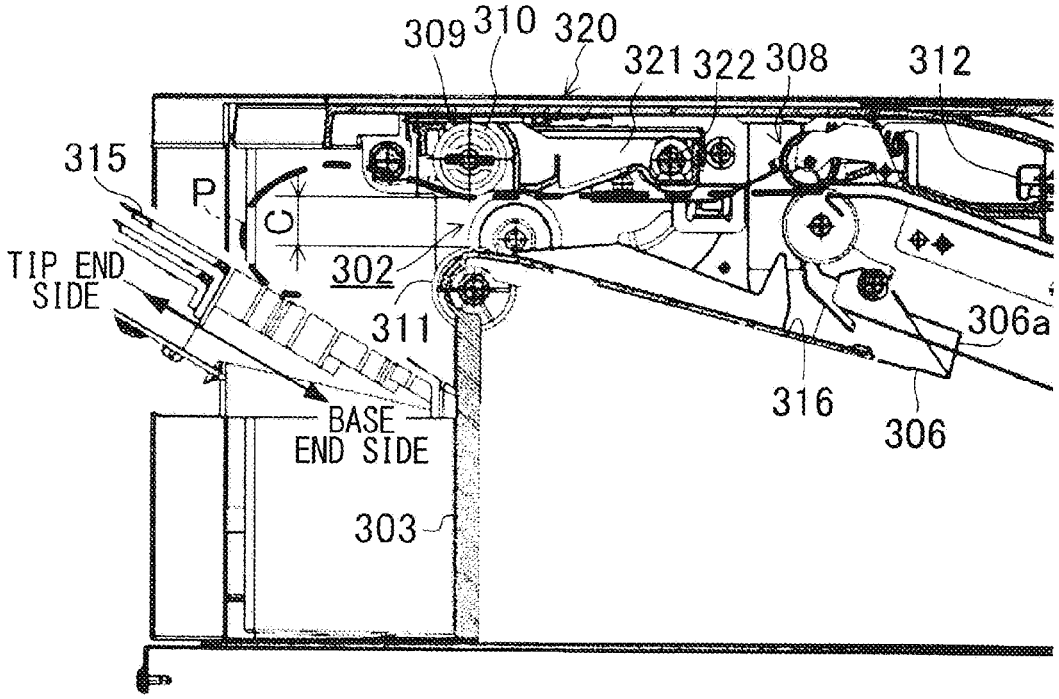
FIG. 11 is a schematic view illustrating how in the comparative example, the front end portion of the sheet makes contact with the paper discharge tray and is moved to the tip end side of the paper discharge tray.

In other words, as illustrated in FIG. 9, when the drive roller 310 is placed on standby in the maximum separate position which is most separate from the driven roller 311, the sheet P can easily be moved between the drive roller 310 and the driven roller 311 in the up/down direction. Hence, for example, disadvantageously, when the front end portion of the sheet P is curled downward, the front end portion of the sheet P may be brought into contact with the paper discharge tray 315 to be moved to the base end side of the paper discharge tray 315 (see FIG. 10) or the front end portion of the sheet P is kept in contact with the paper discharge tray 315 so as not to be moved in the paper discharge direction and thus the front end portion of the sheet P may be swelled upward (see FIG. 11). Consequently, the sheet P may be excessively curled. By contrast, in the embodiment described above, since the space C between the drive roller 310 and the driven roller 311 is small, it is possible to prevent the sheet P from being curled excessively. Thus, it is possible to reliably prevent a paper jam and an alignment failure on the sheet P resulting from the excessive curling of the sheet P.

In the embodiment described above, the standby position of the drive roller 310 when the second and subsequent sheets P are transported above the post-processing tray 316 is set to the maximum separate position. In this way, for the second and subsequent sheets P, it is possible to prevent the sheet P from being caught between both the rollers 310 and 311 by maximizing the space between the driven roller 311 and the drive roller 310.

The second and subsequent sheets P are stacked on the first sheet P already stacked on the post-processing tray 316. Hence, in the second and subsequent sheets P, since an apparent angle of the paper discharge tray 315 is close to a horizontal position, even when the drive roller 310 is placed on standby in the maximum separate position, the sheet P is prevented from being curled excessively.

Furthermore, in the embodiment described above, in a state where the drive roller 310 is in the standby position, the drive roller 310 is driven to rotate in the positive rotation direction.

In this configuration, even when the front end portion of the sheet P transported above the post-processing tray 316 interferes with the drive roller 310 while being passed between the drive roller 310 and the driven roller 311, since the drive roller 310 is rotated in the positive rotation direction, it is possible to apply, to the front end portion of the sheet P, a force acting on the side of the paper discharge tray 315 produced by the rotation force of the drive roller 310. Thus, it is possible to reliably prevent the sheet P from being caught between both the rollers 310 and 311.

Other Embodiments

Although in the embodiment described above, for the second and subsequent sheets P in the stack of sheets to be subjected to the post-processing, the standby position of the drive roller 310 is set to the maximum separate position, there is no restriction on this configuration, and as in the transport of the first sheet P, the standby position of the drive roller 310 may be set between the maximum separate position and the nip position.

Alternatively, for example, as the number of sheets in the stack of sheets stacked on the post-processing tray 316 is increased, the standby position of the drive roller 310 may be moved to the side of the separation from the driven roller 311. In this way, it is possible to prevent the gap between the uppermost sheet P in the stack of sheets stacked on the post-processing tray 316 and the drive roller 310 from being narrowed as the number of sheets in the stack of sheets is increased. Hence, it is possible to prevent a paper jam from occurring due to the interference of the tip end of the sheet P transported onto the post-processing tray 316 with the drive roller 310.

Although in the embodiment discussed above, the example where the post-processing performed by the post-processing device 300 is the stapling processing is described, there is no restriction on this configuration, and the post-processing may be, for example, perforation processing in which a punch hole is produced in the end portion of the sheet P.

Although in the embodiment described above, the sheet P on the post-processing tray 316 is transported by the paper discharge roller pair 309 to the side of the reference plate portion 306*a*, there is no restriction on this configuration, and in addition to the paper discharge roller pair 309, a rotation alignment member may further be included that applies a force acting on the side of the reference plate portion 306 to the sheet P. The rotation alignment member is formed with, for example, a sheet-shaped member whose base end portion is supported by a shaft. When the sheets P are aligned, the sheet-shaped member is rotated around the shaft line of the shaft to bring the tip end portion of the sheet-shaped member into contact with the sheet P. In this way, it is possible to apply a force acting on the side of the reference plate portion 306*a* to the sheet P. Instead of the sheet-shaped member, a plate-shaped member or a roller member in the shape of a cylinder or a cylindroid may be adopted.

As described above, in the post-processing device 300 according to the present embodiment, the sheet transported by the supply roller pair 308 onto the post-processing tray 316 is nipped between the drive roller 310 and the driven roller 311 of the paper discharge roller pair 309 and is supplied to the post-processing transport path T3. Then, the back edge of the sheets supplied to the post-processing transport path T3 makes contact with the reference plate portion 306*a*, and thus the alignment of the sheets is completed. Hence, the sheets can be aligned without provision of, separately from the paper discharge roller pair 309, the means (for example, the rotation alignment member) for applying a force acting on the side of the reference plate portion to the sheet on the post-processing tray 316. Thus, it is possible to reduce the number of components to decrease the product cost.

In the configuration described above, when the sheet is supplied by the supply roller pair 308 onto the post-processing tray 316, the drive roller 310 is driven by the drive controller (the controller 330) to the predetermined standby position. Since in the standby position, the drive roller 310 is separate from the driven roller 311, the front edge of the sheet transported onto the post-processing tray 316 is prevented from being caught between the driven roller 311 and the drive roller 310. The front end portion of the sheet passed between the driven roller 311 and the drive roller 310 protrudes from the paper discharge port 302 to the side of the paper discharge tray 315. Here, for example, when the front end portion of the sheet is curled downward, the front end portion of the sheet is brought into contact with the paper discharge tray 315 to be moved to the base end side of the paper discharge tray 315, and thus, the sheet may be excessively curled. By contrast, in the configuration described above, the standby position of the drive roller 310 when the sheet is transported onto the post-processing tray 316 is set between the maximum separate position and the nip position (that is, the side of the driven roller with respect to the maximum separate position). Hence, even when the front end portion of the sheet makes contact with the paper discharge tray 315, since a sufficient space is not present between the drive roller 310 and the driven roller 311, the sheet is prevented from being curled excessively. Thus, it is possible to reliably prevent a paper jam and an alignment failure on the sheet resulting from the excessive curling of the sheet.

The standby position of the drive roller 310 when the second and subsequent sheets in the stack of sheets to be subjected to the post-processing in the post-processing portion 306 may be the maximum separate position.

In this configuration, for the second and subsequent sheets, it is possible to maximize the space between the driven roller 311 and the drive roller 310, and thus it is possible to prevent the front edge of the sheet from being caught between both the rollers. The second and subsequent sheets are stacked on the first sheet already stacked on the post-processing tray 316. Hence, in the second and subsequent sheets, since an apparent angle of the paper discharge tray 315 is close to a horizontal position, even when the drive roller 310 is placed on standby in the maximum separate position, the sheet is prevented from being curled excessively.

The standby position of the drive roller 310 when the second and subsequent sheets are transported onto the post-processing tray 316 may be set to the position between the maximum separate position and the nip position as in the transport of the first sheet to the post-processing tray 316. In this way, it is possible to reliably prevent the second and subsequent sheets from being curled excessively.

Here, the standby position of the drive roller 310 when the second and subsequent sheets are transported onto the post-processing tray 316 may be moved to the side of the separation from the driven roller 311 as the number of sheets in the stack of sheets on the post-processing tray 316 is increased.

In this way, it is possible to prevent the gap between the uppermost sheet in the stack of sheets stacked on the post-processing tray 316 and the drive roller 310 from being narrowed as the number of sheets in the stack of sheets is increased. Hence, it is possible to prevent a paper jam from occurring due to the interference of the front edge of the sheet transported onto the post-processing tray 316 with the drive roller 310.

Regardless of which one of the sheets is transported onto the post-processing tray 316, when the drive roller 310 is placed on standby in the standby position, the drive controller (the controller 330) is preferably configured so as to rotate and drive the drive roller 310 in the positive rotation direction.

In this configuration, even when the front end of the sheet transported onto the post-processing tray 316 interferers with the drive roller 310, since the drive roller 310 is rotated in the positive rotation direction, it is possible to apply, to the front end portion of the sheet, a force acting on the side of the paper discharge tray 315 produced by the rotation force of the drive roller 310. Hence, it is possible to reliably prevent a paper jam from occurring due to the interference of the front end portion of the sheet with the drive roller 310.

As described above, in the sheet post-processing device according to the present embodiment, the drive roller and the driven roller are configured such that they can be separated from and make contact with the nip position and the maximum separate position, when the sheet transported by the supply roller pair is transported to the post-processing tray, the standby position of the drive roller is set between the nip position and the maximum separate position and thus the front end portion of the sheet transported onto the post-processing tray makes contact with the paper discharge tray, with the result that it is possible to prevent the sheet from being curled excessively.

In the sheet post-processing method according to the present embodiment, when the sheet is transported to the post-processing tray, the driven roller and the drive roller forming the paper discharge roller pair are separated in the predetermined standby position between the nip position and the maximum separate position, after the back edge of the sheet transported is passed through the supply roller pair, the drive roller is moved to the nip position and is rotated in the reverse rotation direction and thus the back end of the sheets is brought into contact with the reference plate portion and can be aligned, with the result that it is possible to prevent the sheet from being curled excessively.

As described above, the present disclosure is useful for the sheet post-processing device that preforms post-processing on the sheet on which an image has been formed with an image forming apparatus such as a copying machine or a printer.

What is claimed is:

1. A sheet post-processing device comprising:

a housing which includes a paper feed port and a paper discharge port;

a main transport path which transports a sheet from the paper feed port to the paper discharge port;

a paper discharge tray which is provided outside the housing and which receives the sheet discharged from the paper discharge port;

a paper discharge roller pair which is provided at a downstream-side end portion of the main transport path;

a supply roller pair which is arranged on an upstream side with respect to the paper discharge roller pair of the main transport path;

a post-processing transport path whose one end portion is connected to the downstream-side end portion of the main transport path and whose other end portion is connected to a post-processing portion that performs post-processing on a stack of sheets;

a post-processing tray which is arranged along the post-processing transport path and on which the sheets supplied by the supply roller pair are sequentially stacked; and a reference plate portion which is provided in the post-processing portion and which makes contact with a back edge of the sheets supplied onto the post-processing tray to align the sheets, wherein the paper discharge roller pair includes a driven roller and a drive roller which is arranged opposite the driven roller and which can be moved between a nip position where a nip portion is formed between the drive roller and the driven roller and a maximum separate position a predetermined distance separate from the driven roller, the post-processing device comprises a drive controller, the drive controller including a first motor for rotating the drive roller and a separate/contact mechanism for holding the drive roller such that the drive roller can be brought into and out of contact with the driven roller, the drive controller controlling an operation of rotation of the drive roller and an operation of separating from and making contact with the driven roller by the drive roller, the drive controller separates the drive roller from the driven roller to place the drive roller on standby in a predetermined standby position when the sheet is supplied and transported by the supply roller pair onto the post-processing tray, moves the drive roller to the nip position after the back edge of the sheet is passed through the supply roller pair and rotates the drive roller in a reverse rotation direction so as to bring the back end of the sheets into contact with the reference plate portion and to align the sheets, the standby position of the drive roller when a first sheet in the stack of sheets to be subjected to the post-processing by the post-processing portion is transported onto the post-processing tray is a first standby position between the maximum separate position and the nip position, and the standby position of the drive roller when second and subsequent sheets in the stack of sheets to be subjected to the post-processing by the post-processing portion are transported onto the post-processing tray is a position farther away from the driven roller than the first standby position is.

2. The sheet post-processing device according to claim 1, wherein the standby position of the drive roller when second and subsequent sheets in the stack of sheets to be subjected to the post-processing by the post-processing portion are transported onto the post-processing tray is the maximum separate position.

3. The sheet post-processing device according to claim 1, wherein the standby position of the drive roller when the second and subsequent sheets in the stack of sheets to be subjected to the post-processing by the post-processing portion are transported onto the post-processing tray is set so as to move away from the driven roller eventually up to the maximum separate position as a number of sheets in the stack of sheets on the post-processing tray is increased.

4. The sheet post-processing device according to claim 1, wherein regardless of which one of the sheets is transported onto the post-processing tray, when the drive roller is placed on standby in the standby position, the drive controller rotates the drive roller in a positive rotation direction.

5. A sheet post-processing method by the sheet post-processing device according to claim 1, comprising, when transporting the sheet to the post-processing tray:

setting the standby position of the drive roller at the first standby position between the maximum separate position and the nip position when a first sheet in the stack of sheets to be subjected to the post-processing by the post-processing portion is transported onto the post-processing tray;

setting the standby position of the drive roller at a position farther away from the driven roller than the first standby position is when second and subsequent sheets in the stack of sheets to be subjected to the post-processing by the post-processing portion are transported onto the post-processing tray;

moving the drive roller to the nip position and rotating the drive roller in the reverse rotation direction after the back edge of the sheet transported has passed through the supply roller pair; and bringing the back end of the sheets into contact with the reference plate portion to align the sheets.

* * * * *